US007784229B2

(12) United States Patent
Ismay

(10) Patent No.: US 7,784,229 B2
(45) Date of Patent: Aug. 31, 2010

(54) WALL PANEL SYSTEM

(75) Inventor: Allan Ismay, Leichhardt (AU)

(73) Assignee: Wovin Wall IP Pty Ltd (AU)

( * ) Notice: Subject to any disclaimer, the term of this patent is extended or adjusted under 35 U.S.C. 154(b) by 682 days.

(21) Appl. No.: 10/574,713

(22) PCT Filed: Jun. 11, 2004

(86) PCT No.: PCT/AU2004/000777

§ 371 (c)(1),
(2), (4) Date: Apr. 5, 2006

(87) PCT Pub. No.: WO2005/033430

PCT Pub. Date: Apr. 14, 2005

(65) Prior Publication Data

US 2007/0017171 A1 Jan. 25, 2007

(30) Foreign Application Priority Data

Oct. 8, 2003 (AU) ..... 2003905499

(51) Int. Cl.

| | |
|---|---|
| ***E04B 1/00*** | (2006.01) |
| ***E04B 2/30*** | (2006.01) |
| ***E04B 9/00*** | (2006.01) |
| ***E04C 2/54*** | (2006.01) |
| ***E04C 2/38*** | (2006.01) |
| ***E04F 13/08*** | (2006.01) |

(52) U.S. Cl. ..... 52/222; 52/775; 52/483.1; 52/780; 52/781; 52/386; 52/387; 52/475.1; 52/476

(58) Field of Classification Search ..... 52/38, 52/531, 521, 533, 535, 536, 539, 546, 555, 52/236.4, 238.1, 235, 384, 43.1, 489.1, 592.1, 52/436, 592.4, 584.1, 127.11, 127.12, 582.2, 52/204.5, 239, 220.7, 220, 307, 656, 64, 52/200, 86, 222, 483.1, 780–781, 475–476, 52/386–387

See application file for complete search history.

(56) References Cited

U.S. PATENT DOCUMENTS 3,388,515 A * 6/1968 Gruettner ..... 52/222

(Continued)

FOREIGN PATENT DOCUMENTS

AU 23436/70 6/1972

(Continued)

*Primary Examiner*—Brian E Glessner
*Assistant Examiner*—Omar Hijaz
(74) *Attorney, Agent, or Firm*—Fraser Clemens Martin & Miller LLC; Donald R. Fraser

(57) ABSTRACT

The invention provides a wall panel system including a supporting structure; and a plurality of plates (3), each plate having a first pair of edges (6) for engaging with the support structure and a second pair of edges (9), each plate being shaped such that the second pair of edges (9) conceal the engagement of corresponding adjacent plates with the support structure. In one preferred embodiment the supporting structure includes a mounting board (1) including a plurality of retaining elements (2) adapted for engagement with the first pair of edges (6) of each plate. Preferably each retaining element (2) includes a supporting lip (5), wherein the support edge (6) of a plate is engagable with a supporting lip (5) of a retaining element. The retaining elements may, for example, be arranged in a rectangular or square grid on the mounting board (1).

40 Claims, 14 Drawing Sheets

U.S. PATENT DOCUMENTS 4,121,396 A * 10/1978 Oogami et al. ..... 52/235
4,571,897 A * 2/1986 Kerr ..... 52/13
4,723,386 A * 2/1988 Sandow ..... 52/200
5,537,792 A 7/1996 Moliere
5,584,566 A * 12/1996 Bowman et al. ..... 362/220
5,623,800 A * 4/1997 Shinkosky ..... 52/468
5,809,709 A * 9/1998 Ryan et al. ..... 52/222
5,809,729 A * 9/1998 Mitchell ..... 52/474
6,694,694 B2 * 2/2004 Zeeff ..... 52/506.01
2002/0059777 A1 * 5/2002 Saebi ..... 52/745.07

FOREIGN PATENT DOCUMENTS

| | | |
|---|---|---|
| DE | 201 08 950 U1 | 9/2001 |
| EP | 0414519 A2 | 2/1991 |
| NL | 8 702 073 | 4/1989 |
| WO | WO 95/18900 | 7/1995 |
| WO | WO 98/09038 | 3/1998 |

* cited by examiner

WALL PANEL SYSTEM

FIELD OF THE INVENTION

The present invention relates to a wall panel system. The invention has been developed primarily as a decorative wall panel system and will be described hereinafter with reference to this application. However, it will be appreciated that the invention is not limited to this particular field of use.

BACKGROUND OF THE INVENTION

Any discussion of the prior art throughout the specification should in no way be considered as an admission that such prior art is widely known or forms part of the common general knowledge in the field.

Wall panel systems are used in a variety of applications. For example, a wall panel system are often used to create a feature wall in a room or to create a partition which divides the space within a room. Alternatively, a wall panel systems are used in commercial applications, such as a demountable display for advertising purposes.

It is an object of the present invention to provide a wall panel system that overcomes or substantially ameliorates one or more of the disadvantages of the prior art, or at least provides a useful alternative to known wall panel systems.

DISCLOSURE OF THE INVENTION

To this end, the present invention provides a wall panel system including:

a supporting structure; and a plurality of plates, each plate having a first pair of edges for engaging with the support structure and a second pair of edges, each plate being shaped such that the second pair of edges conceal the engagement of corresponding adjacent plates with the support structure.

In one preferred embodiment the supporting structure includes a mounting board including a plurality of retaining elements adapted for engagement with the first pair of edges of each plate. Preferably each retaining element includes a supporting lip, wherein the support edge of a plate is engagable with a supporting lip of a retaining element. The retaining elements may, for example, be arranged in a rectangular or square grid on the mounting board.

In one embodiment the retaining elements and the plates are adapted to allow the first pair of edges of two plates, placed on the opposite sides of the mounting board, to be retained by a single retaining element. This permits plates to be mounted on opposing sides of the mounting board.

In one embodiment the retaining elements take the form of grooves or openings provided at predetermined locations on the board.

In one embodiment the supporting structure includes a plurality of retaining brackets adapted to be, directly or indirectly, engagable with each other. In one preferred embodiment, joiner elements are used to interconnect two or more brackets. Preferably, the retaining brackets are interconnectable by the joiner elements to form a rectangular or square grid.

Preferably each retaining bracket includes a supporting lip such that each support edge of each the plate is engagable with the supporting lip of a corresponding bracket.

Preferably the brackets and plates are adapted to allow two plates, placed on the opposite sides of a bracket, to be supportingly engagable with the bracket.

Preferably, the brackets are produced by extrusion or moulding. The brackets may, for example, be formed of aluminium or plastic.

In another preferred embodiment the supporting structure includes a mounting board and a plurality of retaining elements engagable with the board at predetermined locations on the board, the elements adapted to supportingly engage the first pair of edges of each plate.

Preferably the board includes a plurality of locating openings and the brackets are adapted to be engagable with the openings. Preferably the openings are slots. Preferably, the slots are arranged in a rectangular or square grid on the mounting board.

Preferably, each retaining bracket includes a supporting lip for engaging and retaining an edge of a plate. Preferably the brackets are produced by extrusion or moulding. The brackets may, for example, be formed from aluminium or plastic.

In one embodiment, the slots and brackets are adapted to allow two brackets, placed on the opposite sides of the mounting board, to be co-located in a single slot.

Preferably, the plates are relatively thin and made of a resilient material such as plastic or wood.

Preferably the plates engage with the supporting structure in a bowed configuration.

In one embodiment the plates are pre-curved.

Preferably, the first pair of edges of the plate comprise two opposing edges.

Preferably, when mounted on the support structure the first pair of edges of each two adjacent plates are substantially orthogonal.

Preferably, each of the second pair of concealing edges is convexly shaped.

In one embodiment, the plates are made of transparent or semitransparent material. The system may further include a light source positioned behind the plates for illumination.

In one embodiment, the external surface of each plate includes a section of a larger image, such that a combination of plates creates an image that is substantially larger in size than the size of a single plate.

BRIEF DESCRIPTION OF THE DRAWINGS

Preferred embodiments of the invention will now be described, by way of example only, with reference to the accompanying drawings in which.

PREFERRED EMBODIMENTS OF THE INVENTION

Figure 1:
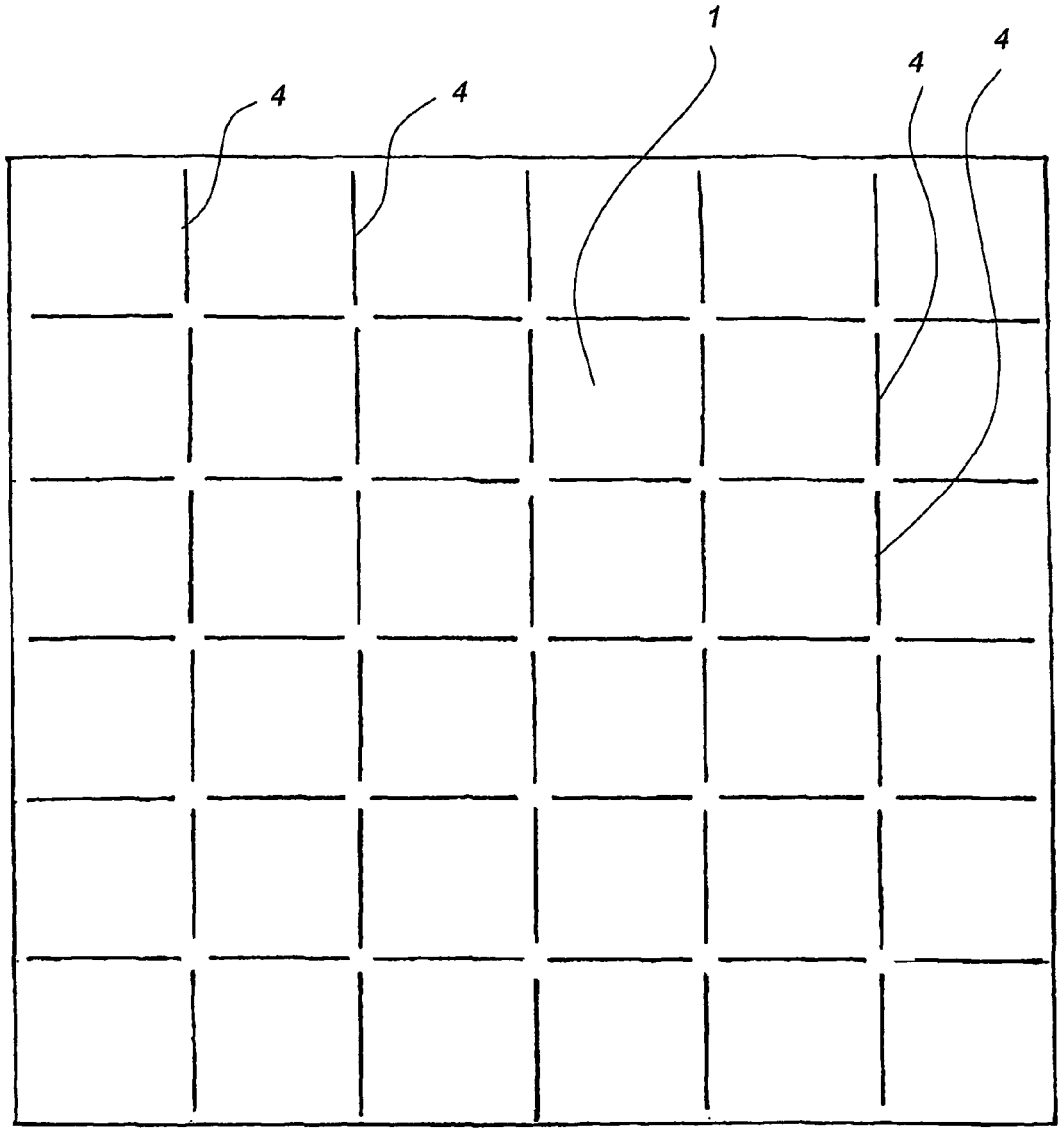
FIG. 1 is a plan view of a mounting board for use in one embodiment of the invention, the mounting board including an array of mounting slots arranged in a square grid.
Figure 2:
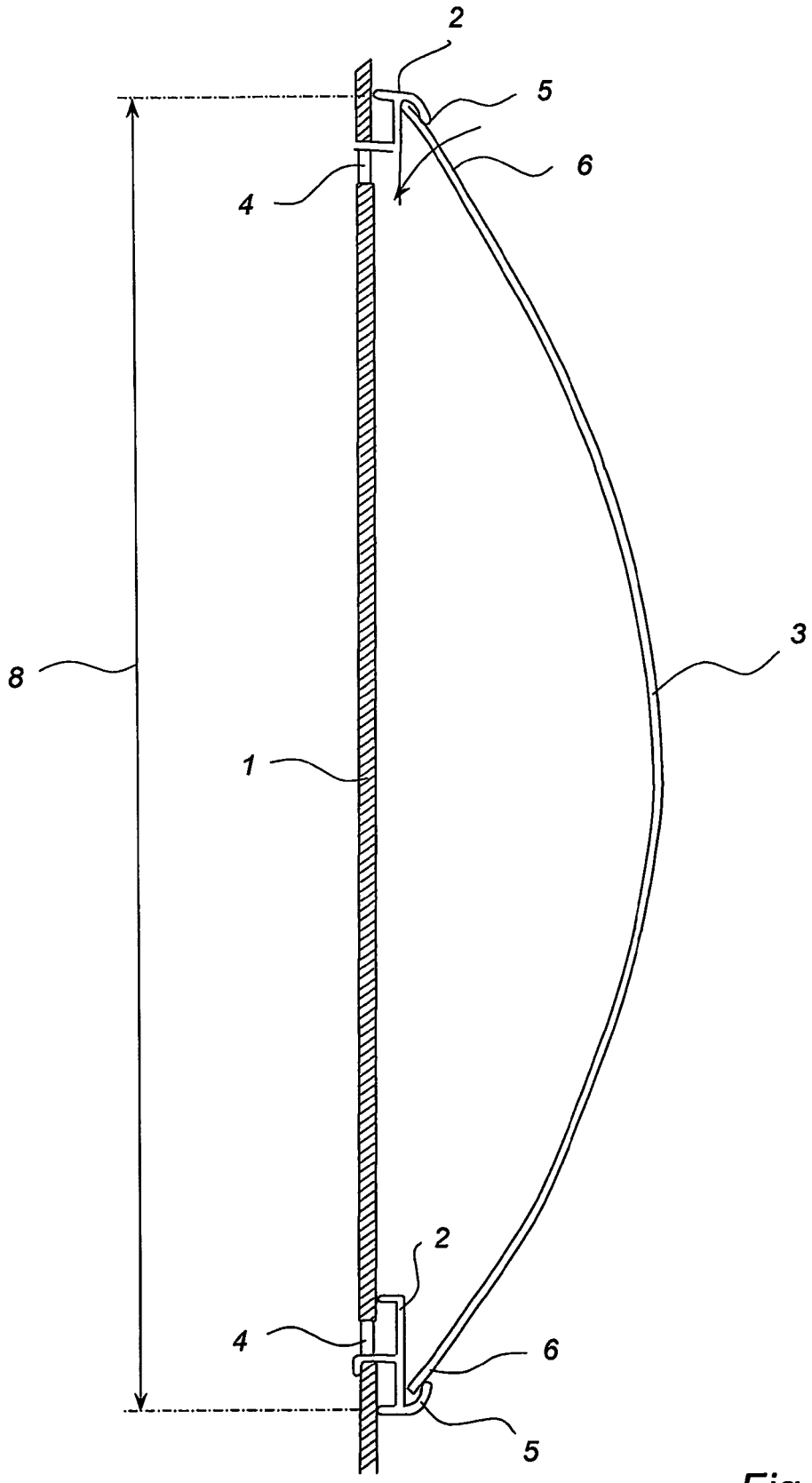
FIG. 2 is a cross-sectional view of a pair of retaining brackets engaged on a Mounting board and supporting a plate.

Referring to FIGS. 1 & 2, one embodiment of the wall panel system according to the present invention includes a supporting structure in the form of a mounting board 1, a plurality of retaining brackets 2 and a plurality of plates 3.

The mounting board 1 includes a plurality of locating slots 4 at predetermined locations. In the embodiment depicted in FIG. 1 the slots are configured in a square grid, although it should be appreciated that the locating slots 4 can be configured in various other arrangements. Furthermore, it should be appreciated that other types of openings, such as round holes, may be used instead of slots. Alternatively, the retaining brackets 2 can be mountable to the board 1 by mechanical fixing means such as screws or bolts or by providing them with projections engaging in an interference fit with holes provided at predetermined locations on the board.

Each bracket 2 is engagable with a slot 4 on the mounting board and includes a supporting lip 5 for engagement with a plate 3, as shown in FIG. 2. In one embodiment, illustrated in FIG. 3, the slots and the brackets are adapted so as to allow two brackets 2, placed on the opposite sides of the mounting board 1, to be co-located in a single slot 4. This embodiment permits plates 3 to be mounted on each side of the mounting board 1.

Each plate has a pair of opposing edges 6 which engage the lips 5 of a corresponding pair of opposing brackets 2. The plates engage with the lips in an outwardly bowed configuration, as illustrated in FIG. 2. In order to be sufficiently flexible, each plate has a relatively thin cross-section. Preferably the plates are made of a suitably resilient material, such as plastic or wood. In the embodiment depicted the plates are resiliently deformed in order to engage between the lips of a pair of brackets. The resilient nature of the plate creates a force which acts against the lips of the brackets and assists in retaining the plate in position.

Figure 4A:
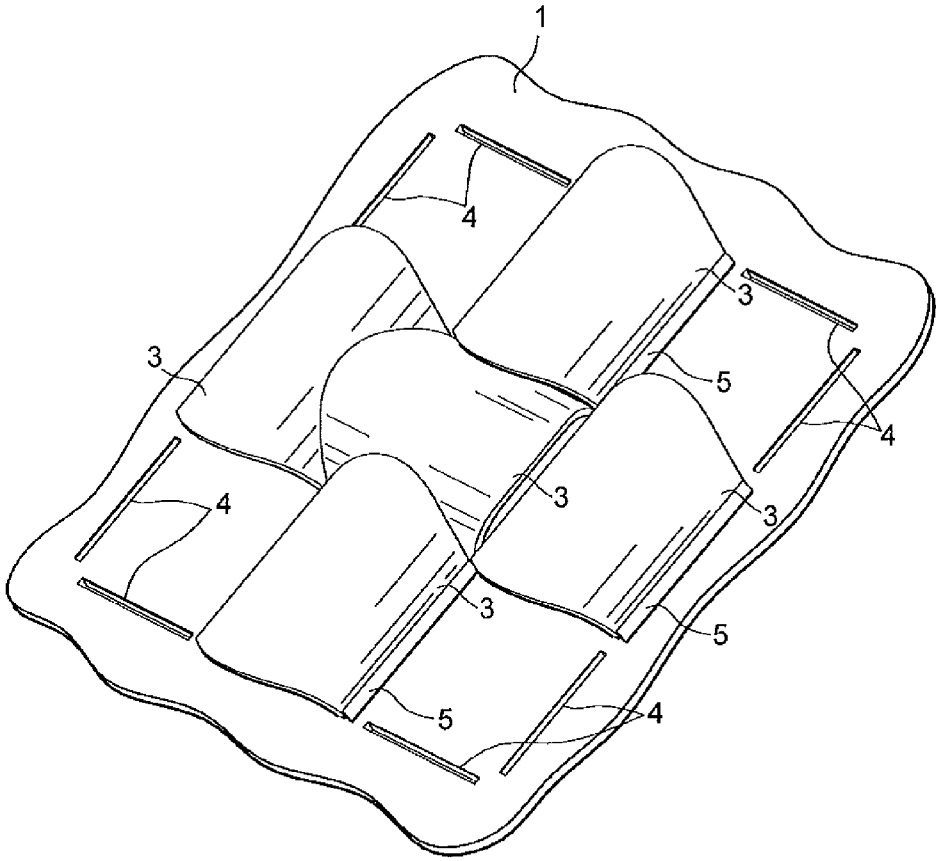
FIG. 4*a* is a fragmentary perspective view of five adjacent plates mounted on the mounting board.
Figure 4B:
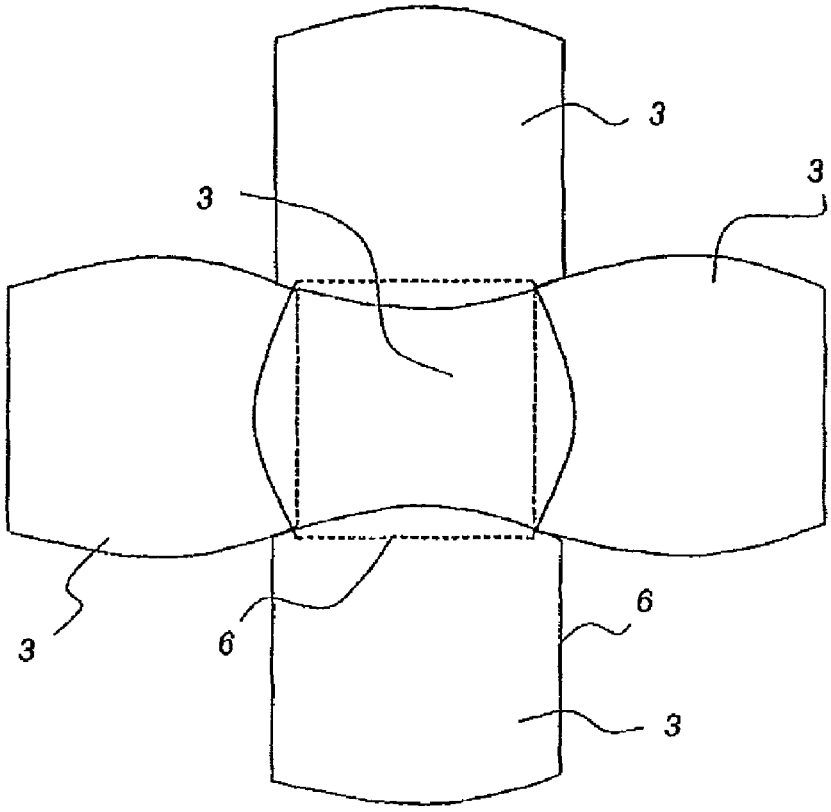
FIG. 4*b* is a schematic plan view of the five adjacent plates of FIG. 4*a;*
Figure 5:
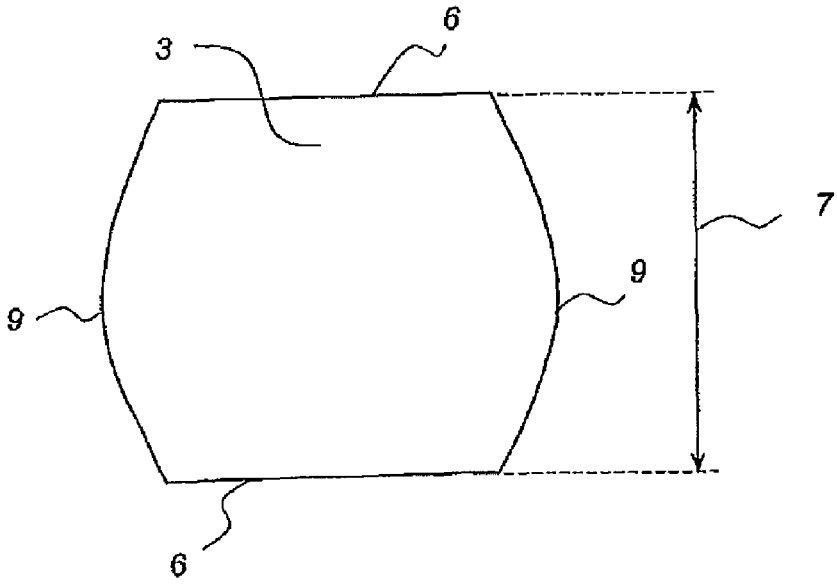
FIG. 5 is a plan view of a plate for use in the wall panel system.

The plates 3 are arranged on the mounting board such that the first pair of edges 6 of each two adjacent plates are orthogonal, as best shown in FIGS. 4*a* and 4*b*. As illustrated in FIG. 5, each plate includes a second pair of opposing edges 9, each convexly shaped so as to conceal the retaining brackets 2 holding the corresponding adjacent plates 3, as illustrated in FIGS. 4*a* and 4*b*.

In one practical example, the mounting board 1 is of the order of 3 mm thick and made of plywood or plastic. The slots 4 are of the order of 200 mm long and 8 mm wide and the distance between their centres is approximately 240 mm. The plates 3 are of relatively thin cross-section, their thickness typically being less than several millimeters, and are made of a resilient material such as plastic or wood. The plates 3 can have a variety of finishes, or can be coloured in a plurality of colours, so as to create the desired visual appearance.

Figure 3:
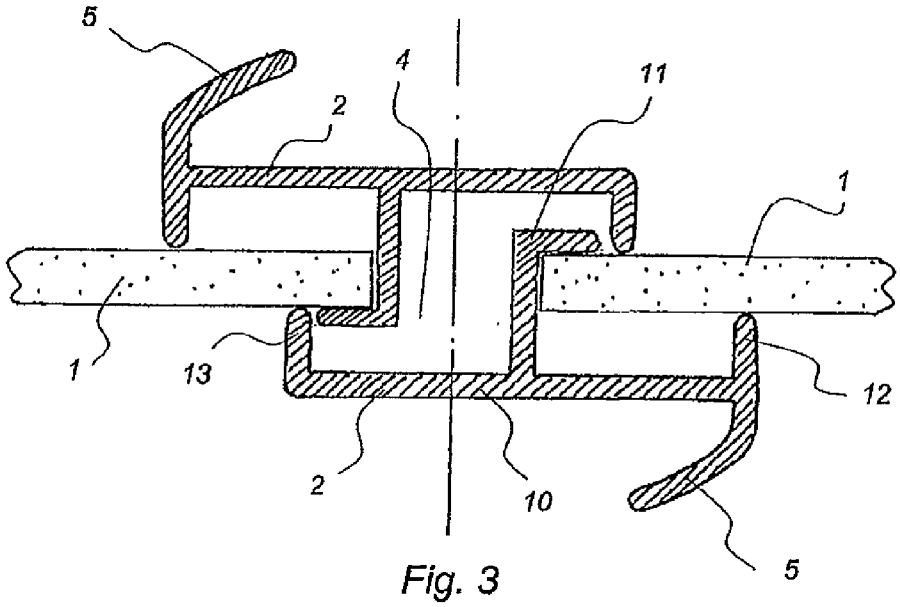
FIG. 3 is a cross-sectional view of a pair of support brackets mounted in a single locating slot on opposing sides of the mounting board.
Figure 6:
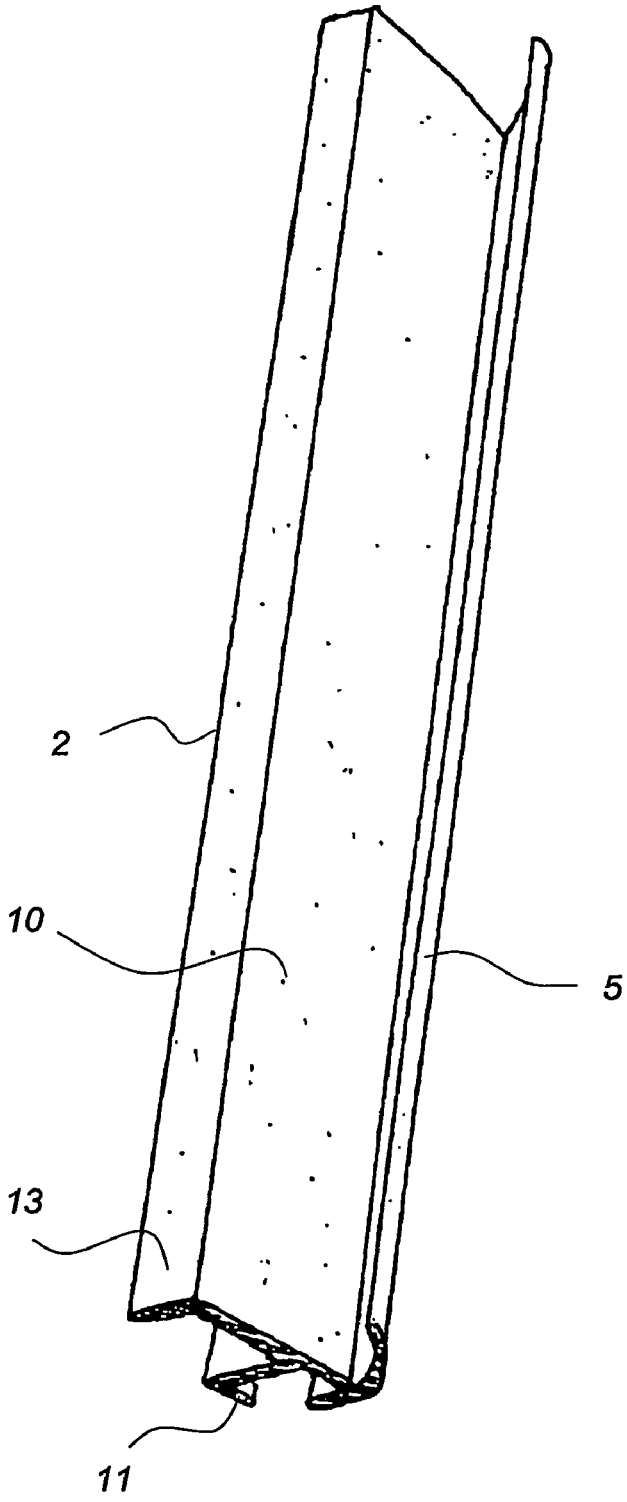
FIG. 6 is a perspective view of a supporting bracket for use in one embodiment of the wall panel system.
Figure 7A:
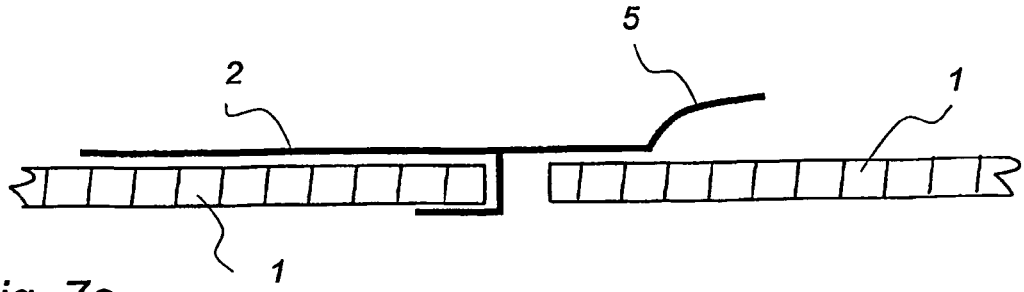
FIGS. 7*a* to 7*d* are cross-sectional illustrations of other possible profiles of a retaining bracket.
Figure 7B:
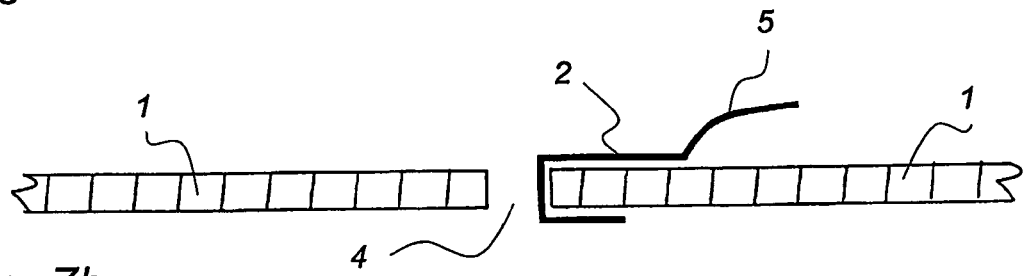
Figure 7C:
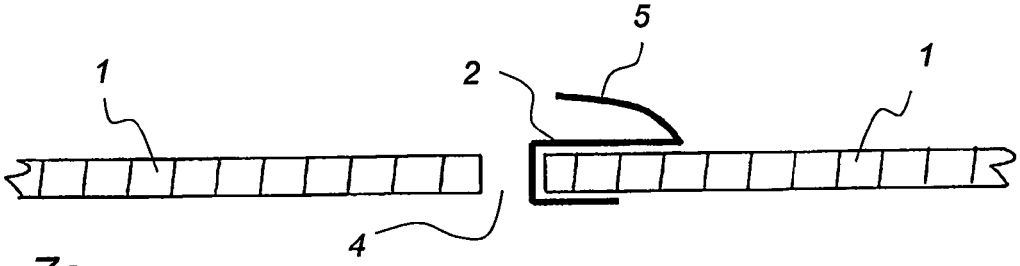
Figure 7D:
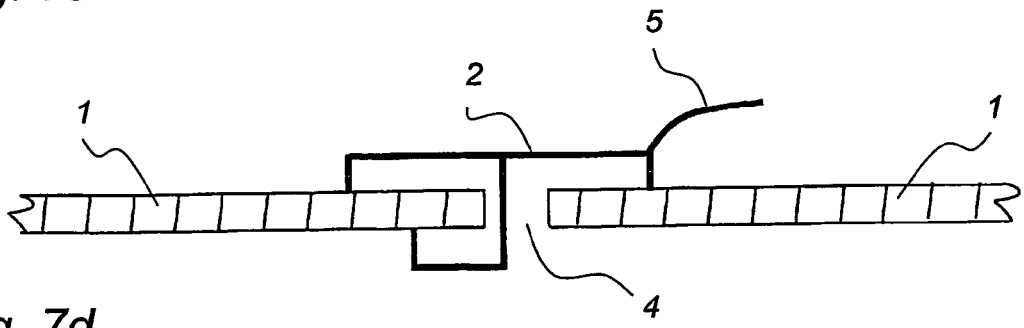

One preferred embodiment of the mounting bracket 2 is illustrated in FIGS. 3 & 6. Each bracket includes a base plate 10, a tongue 11 for gripping onto the wall of the slot, first and second stabilising flanges 12, 13 and a lip 5 for engaging an edge of a plate. The height of the stabilising flanges 12 and 13 is chosen to provide sufficient clearance space underneath the tiles so as to allow easy mounting of the plates. It will be appreciated by those skilled in the art that there are many other possible constructions and profiles of the brackets, some of which are illustrated in FIGS. 7*a* to 7*d*. Preferably the brackets are produced by means of extrusion or moulding, either being a relatively inexpensive production method that permits the use of inexpensive materials such as aluminium or plastic.

Figure 8:
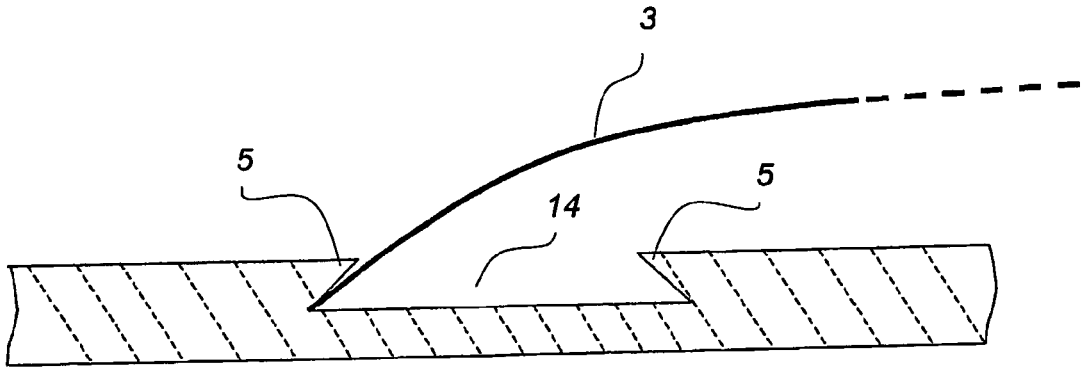
FIG. 8 illustrates a cross-section of another embodiment of the wall panel system wherein the plate engages directly in grooves formed on the mounting board.

In another embodiment of the invention the mounting of the plates 3 on the mounting board 1 can be achieved without the use of retaining brackets. For example, grooves or slots may be formed directly in the surface of the mounting board 1 to allow mounting of the plates directly onto the board, as illustrated in FIG. 8. In this embodiment grooves 14 are formed in the mounting board 1 at predetermined locations. Each groove 14 includes a lip 5 for engaging and supporting the edge of a plate 3. Typically the grooves are arranged on the board in the form of a square grid, although it should be appreciated that other configurations are possible.

Figure 9:
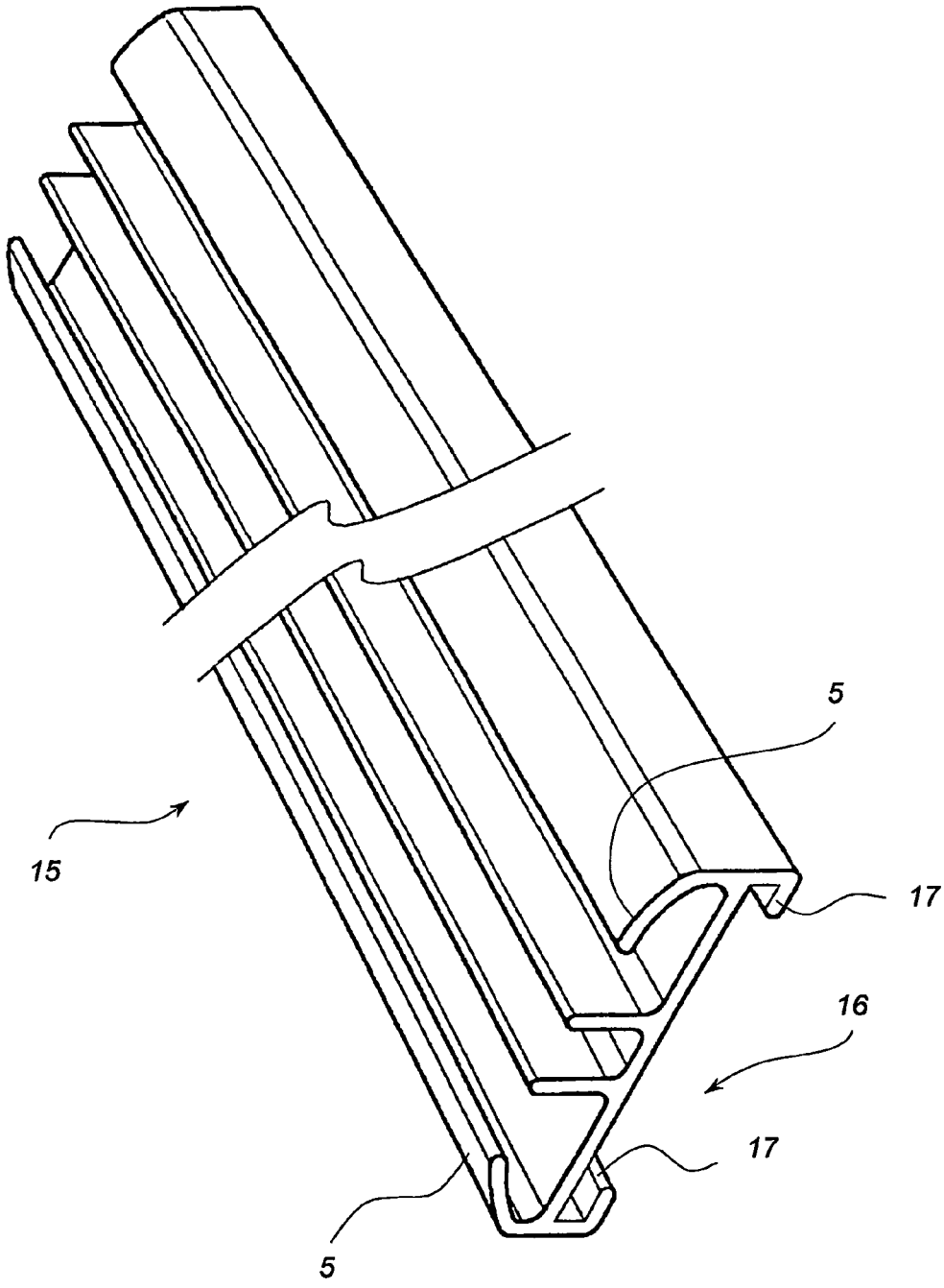
FIG. 9 illustrates a perspective view of a retaining element.
Figure 10:
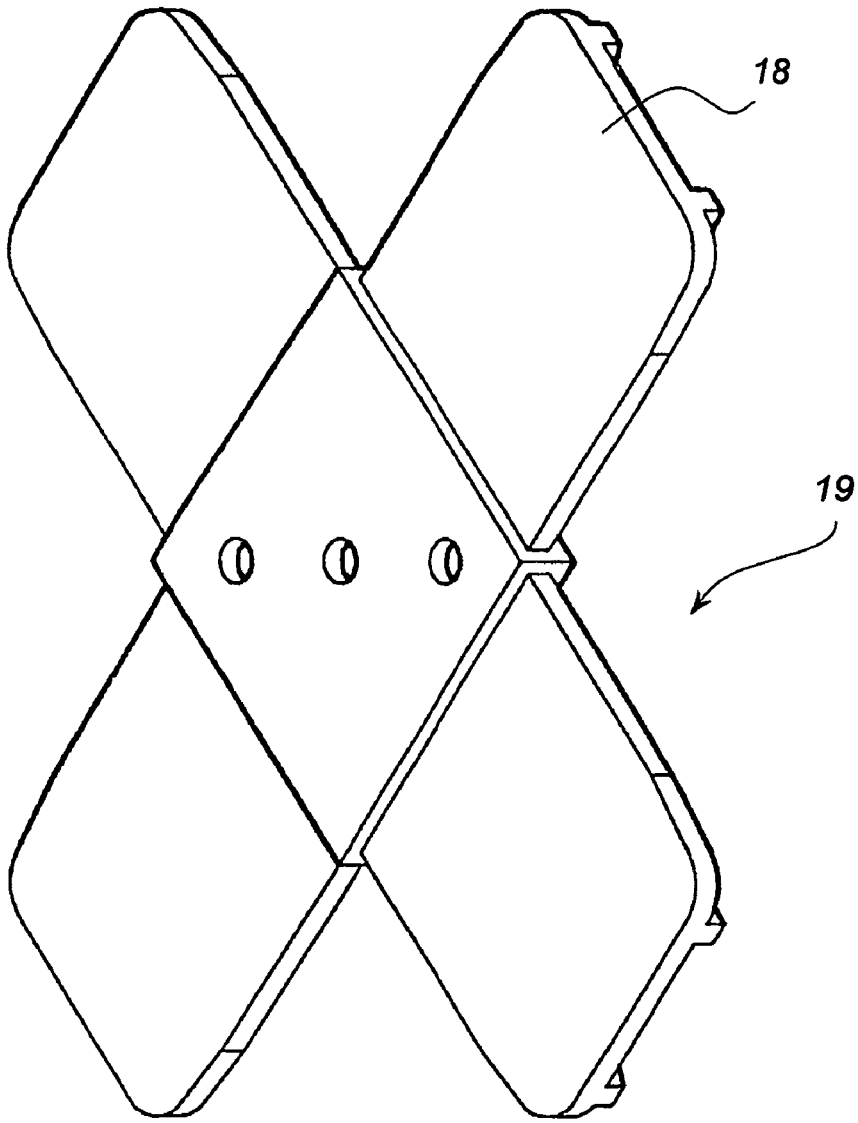
FIG. 10 is a perspective view of a joiner.
Figure 11A:
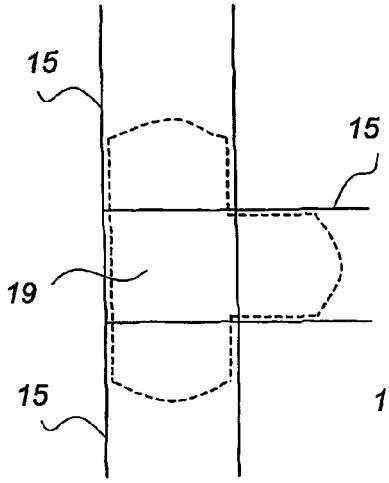
FIGS. 11*a* to 11*d* illustrate the connection of the retaining elements by means of the joiners.
Figure 11B:
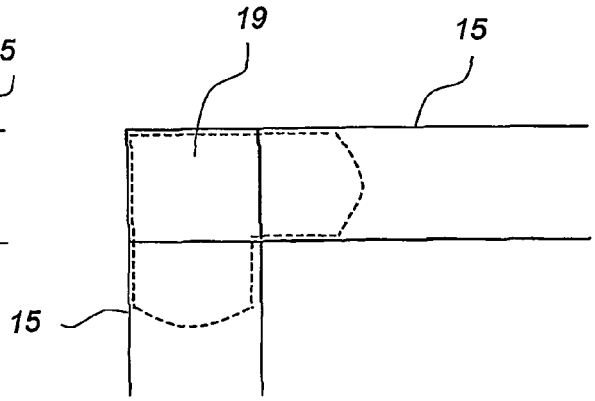
Figure 11C:
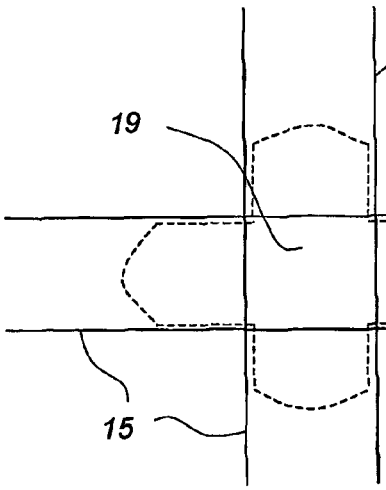
Figure 11D:
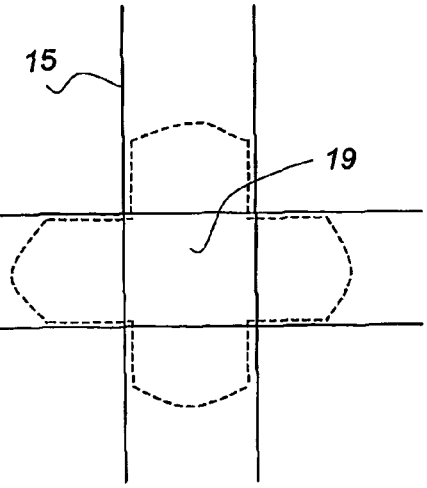
Figure 12:
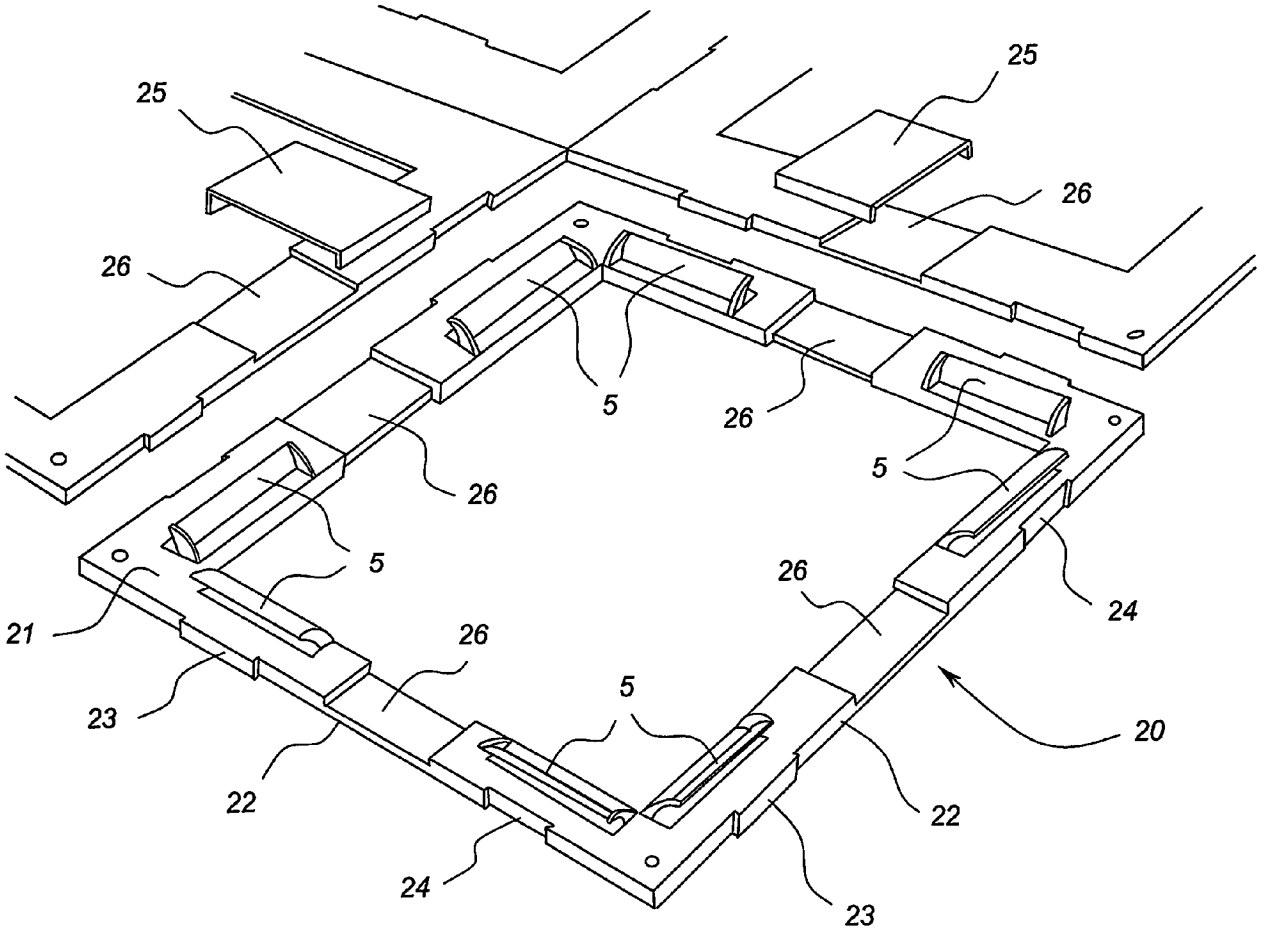
FIG. 12 illustrates a perspective view of a further embodiment of the invention wherein the supporting structure comprises a series of interlocking members.
Figure 13:
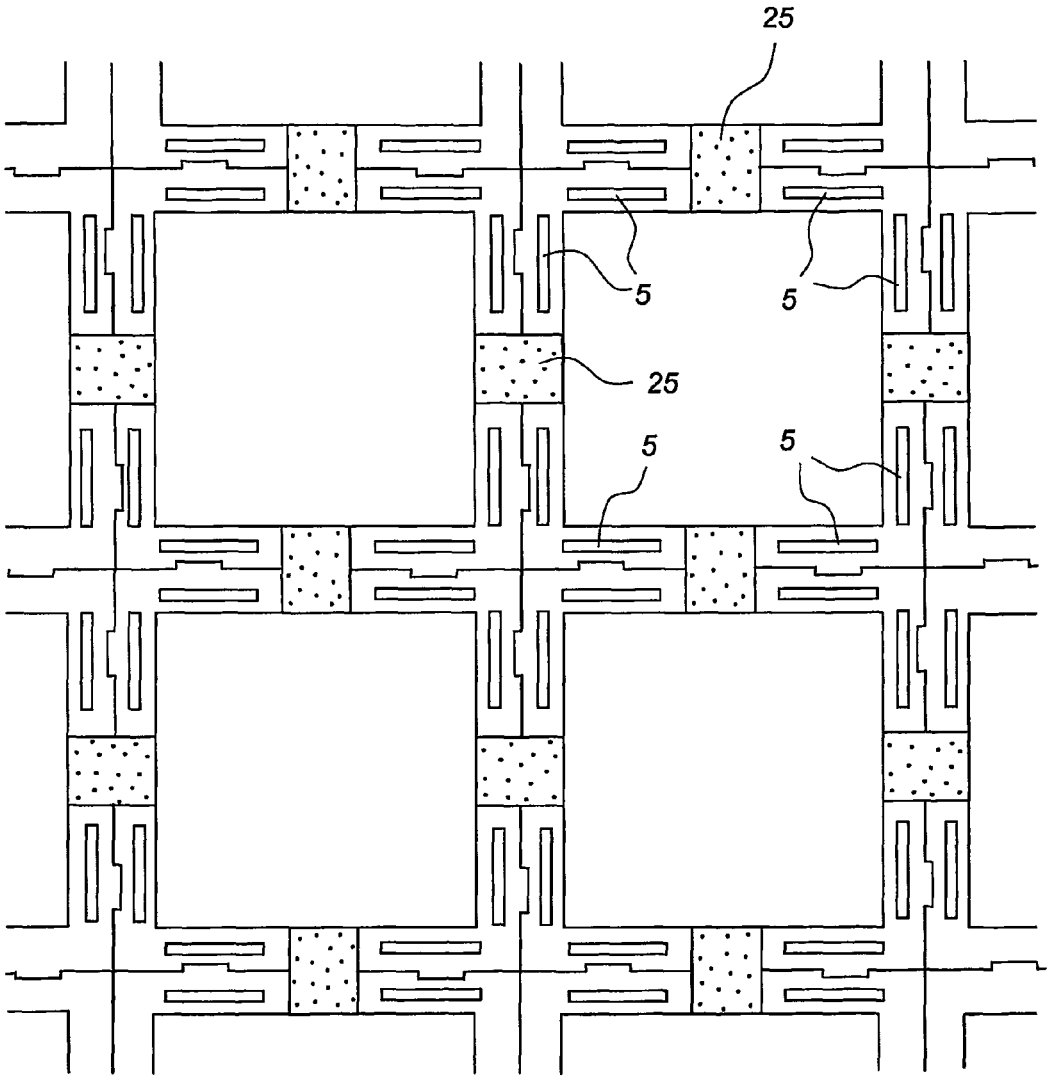
FIG. 13 illustrates a plan view of a support structure formed from a series of the interlocking members shown in FIG. 12.
Figure 14A:
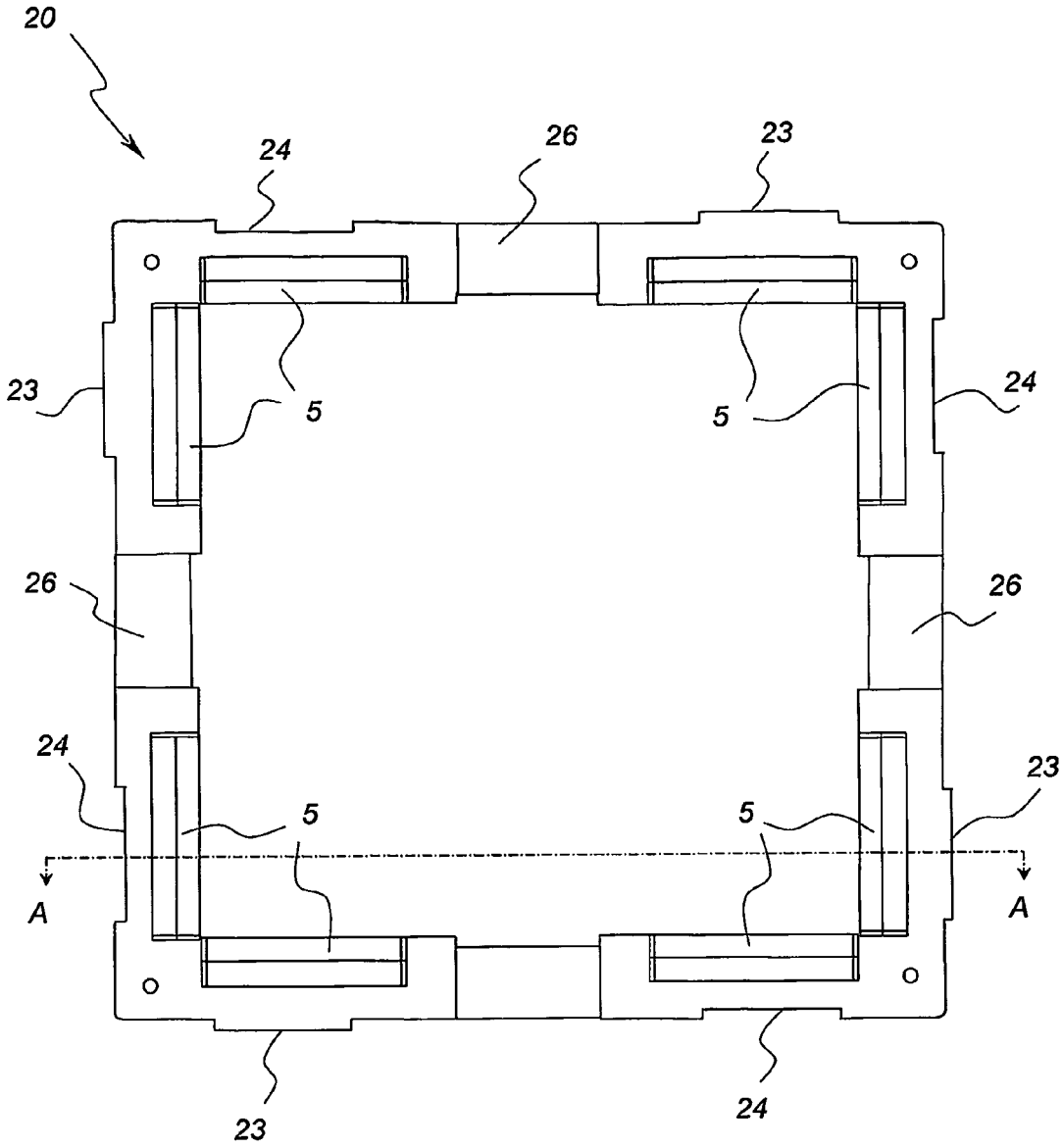
FIG. 14*a* is a plan view of a member shown in FIG. 12.
Figure 14B:
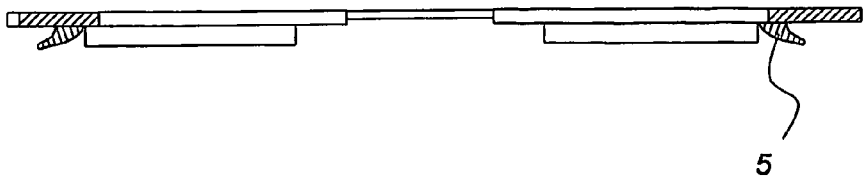
FIG. 14*b* is a cross-section of the member illustrated in FIG. 14*a*.
Figure 15:
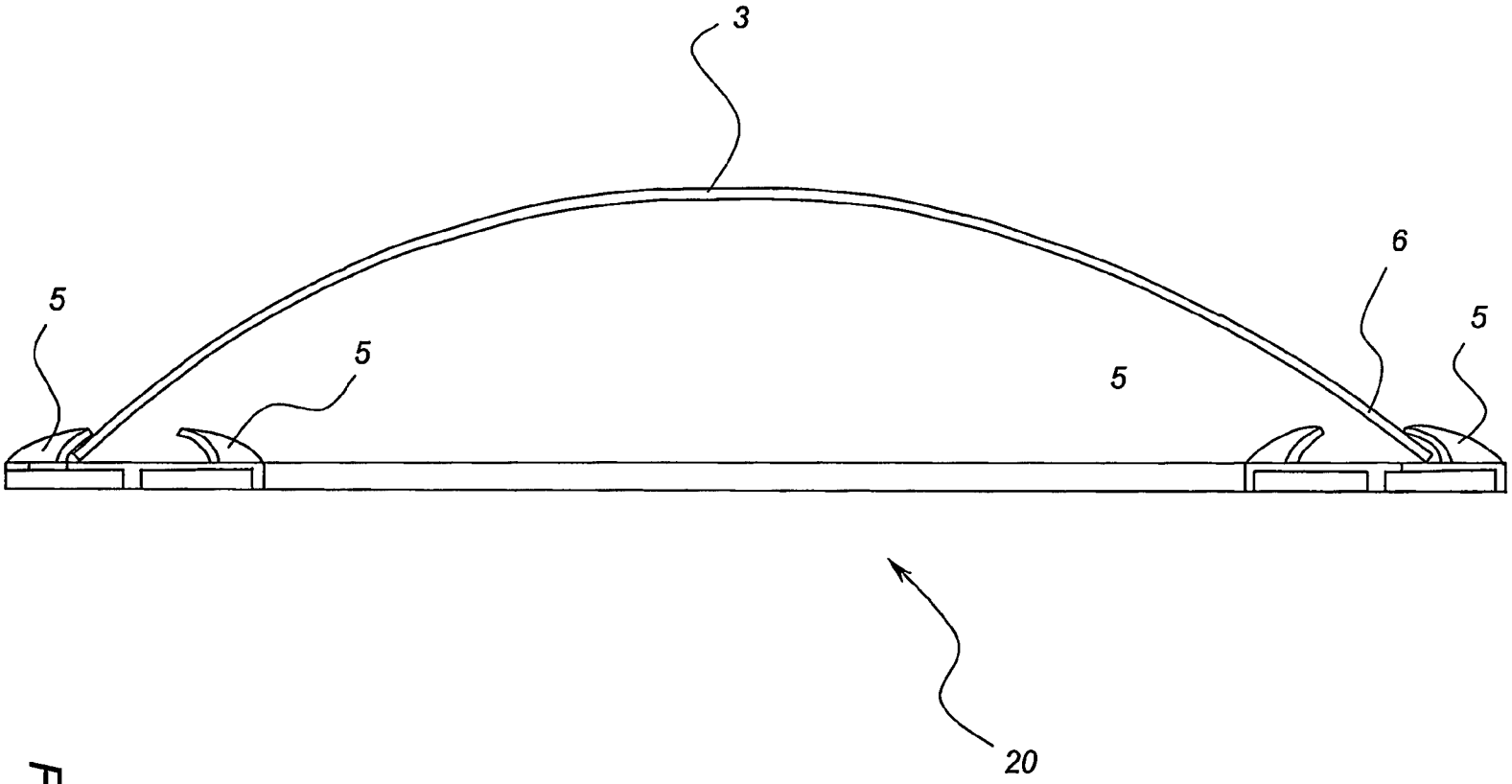
FIG. 15 is a cross-sectional view of a member and plate element.

In a further embodiment, the supporting structure takes the form of a set of interconnectable retaining brackets, thereby alleviating the need for a mounting board. In this embodiment the retaining brackets are adapted to be connected together by means of joiner elements. One embodiment of a bracket 15 is illustrated in FIG. 9. One side of each bracket includes supporting lips 5 for locating and supporting the edge of a plate. The opposing side 16 of the bracket includes lips 17 which define a recess adapted to receive the tongue 18 of a joiner element 19 illustrated in FIG. 10. The joiner element 19 includes two or more tongues 18 for connecting two or more brackets to form a frame work for supporting the plates. A schematic illustration of some possible type of engagements is illustrated in FIGS. 11*a* to 11*d*.

FIGS. 12 to 15 illustrate a further embodiment of the present invention. This embodiment of the invention provides a modular arrangement for constructing a supporting structure for the plates 3 from a series of interlocking members 20. In the embodiment depicted the members 20 are substantially square in shape, although it should be noted that other shapes and configurations are possible. The outer periphery 22 of each member is provided with projections and recesses 23, 24 to engage with corresponding recesses and projections in the outer periphery of adjacent members. When adjacent members are correctly located in position, the projection on one member is received in a recess of the adjacent member. A clip 25 is used to lock the adjacent members together. A recess 26 is provided in the outer surface of each member to receive the clip 25 so as to provide a substantially flush fit for the clip when it is in a locking position. The outer surface of the members is provided with supporting lips 5 for locating and supporting the edge of plates 6 as per the other embodiments of the invention previously described.

It should be noted that instead of flat and flexible plates which engage with the retaining brackets by means of bowing, it may be possible to use pre-curved plates. These alternative plates may require alternative means of attachment, but can still include suitably shaped side edges that conceal these attachment means.

There are different possible arrangements for the periphery of the board. One arrangement can include framing the edges of the mounting board with extruded or moulded trim pieces that can be identical of different from that of the retaining brackets. It should be appreciated that for a better decorative framing effect the trim pieces can be attached not to the periphery of the board itself, but to border pieces attached to the periphery, but being transversal to the board.

It will be appreciated that the wall panel system, according to the present invention, can be provided in a kit form that is easy to assemble, to use and to disassemble. In use, it also allows an easy rearrangement of the plates into different images. It can also have a strong aesthetic appeal that can classify some of the embodiments of the invention as art objects. The visual impact can be modified by colouring the plates or covering them with a sheet material carrying a particular artistic or otherwise image. The images that can be visualised in this way can have various sizes. One particular way of doing this with a large image is by printing the image on a sheet material (for example vinyl), dividing it into portions corresponding to the size of the plates, cut it into pieces and adhere these to the corresponding plates. This will result in an artistic presentation of an image that can be substantially larger than the size of a single plate. A back lightning provided by placing light source/s behind the plates can further enhance the visual effect.

Although the invention has been described with reference to a specific example, it will be appreciated by those skilled in the art that the invention can be embodied in many other forms.

The claims defining the invention are as follows:

1. A wall panel system comprising:

a supporting structure;

a plurality of flexible, resilient plates;

each of said plates having a first pair of opposing supporting edges for engaging with said support structure and a second pair of opposing concealing edges; and each of said plates being retained on said support structure in a bowed configuration with said supporting edges engaging with said support structure, wherein adjacent plates are configured on said support structure in alternating directions such that the concealing edges of at least one of said plates overlay and conceal the supporting edges of adjacent ones of said plates.

2. A wall panel system according to claim 1 wherein said supporting structure includes a mounting board including a plurality of retaining elements supportingly engagable with the first pair of edges of each plate.

3. A wall panel system according to claim 2, wherein each said retaining element includes a supporting lip such that each of the supporting edges of each of said plates is engagable with the supporting lip of a corresponding retaining element.

4. A wall panel system according to claim 2 or claim 3, wherein said retaining elements are arranged hi a rectangular grid.

5. A wall panel system according to claim 4, wherein said retaining elements are arranged in a square grid.

6. A wall panel system according to claim 2, wherein said retaining elements and said plates are adapted to allow the first pair of edges of two plates, placed on the opposite sides of said mounting board, to be co-retained to a single retaining element.

7. A wall panel system according to claim 2, wherein said retaining elements are grooves provided into a surface of said board.

8. A wall panel system according to claim 2, wherein said retaining elements are openings provided at predetermined locations on said board.

9. A wall panel system according to claim 2, wherein said board is made out of plywood or plastic.

10. A wall panel system according to claim 1 wherein said supporting structure includes a plurality of retaining brackets adapted to be, directly or indirectly, supportingly engagable with each other and with said first pair of edges of each plate.

11. A wall panel system according to claim 10, including joiner elements adapted to interconnect more than one bracket.

12. A wall panel system according to claim 11, wherein said retaining brackets are interconnectable by said joiner elements in a rectangular grid.

13. A wall panel system according to claim 12, wherein said retaining brackets are interconnectable by said joiner elements in a square grid.

14. A wall panel system according to any one of claims 10 to 13, wherein each said retaining bracket includes a supporting lip such that each of the supporting edges of each of said plates is engagable with the supporting lip of a corresponding bracket.

15. A wall panel system according to any one of claims 10 to 13, wherein said brackets and said plates are adapted to allow two plates, placed on the opposite sides of a bracket, to be supportingly engagable with a single bracket.

16. A wall panel system according to any one of claims 10 to 13, wherein said brackets are produced by extrusion or moulding.

17. A wall panel system according to any one of claims 10 to 13, wherein said brackets are made of aluminium.

18. A wall panel system according to any one of claims 10 to 13, wherein said brackets are made of plastic.

19. A wall panel system according to claim 1 wherein said supporting structure includes a mounting board and a plurality of retaining elements engagable with said board at predetermined locations, said retaining elements adapted to supportingly engage the first pair of edges of each plate.

20. A wall panel system according to claim 19 wherein said retaining elements are brackets.

21. A wall panel system according to claim 20 wherein said board includes a plurality of locating openings and wherein said brackets are adapted to be engagable with said openings.

22. A wall panel system according to claim 21 wherein said openings are slots.

23. A wall panel system according to any one of claims 20 to 22, wherein each said retaining bracket includes a supporting lip such that the support edge of each plate is engagable with the supporting lip of a corresponding bracket.

24. A wall panel system according to claim 22, wherein said slots are arranged in a rectangular grid.

25. A wall panel system according to claim 22, wherein said slots are arranged in a square grid.

26. A wall panel system according to any one of claims 22, 24, and 25, wherein said slots and brackets are adapted to allow two brackets, placed on the opposite sides of said mounting board, to be co-located in a single slot.

27. A wall panel system according to any one of claims 22, 24, and 25, wherein said brackets are produced by extrusion or moulding.

28. A wall panel system according to any one of claims 20 to 22, 24, and 25, wherein said brackets are made of aluminium.

29. A wall panel system according to any one of claims 20 to 22, 24, and 25, wherein said brackets are made of plastic.

30. A wall panel system according to any one of claims 19 to 22, 24, and 25, wherein said board is made out of plywood or plastic.

31. A wall panel system according to any one of claims 1 to 3, 6 to 13, and 19-22, wherein said plates are relatively thin and made of a resilient material.

32. A wall panel system according to claim 31, wherein said plates are made of plastic.

33. A wall panel system according to claim 31, wherein said plates are made of wood.

34. A wall panel system according to claim 31, wherein a distance between said support edges of each said plate is longer than a distance between points of engagement with said supporting structure such that said plates are adapted to engage with said supporting structure in a bowed configuration.

35. A wall panel system according to any one of claims 1 to 3, 6 to 13, and 19-22, wherein said plates are pre-curved.

36. A wall panel system according to any one of claims 1 to 3, 6 to 13, and 19-22, wherein said first pair of edges includes two opposing edges.

37. A wall panel system according to any one of claims 1 to 3, 6 to 13, and 19-22, wherein the support edges of each two adjacent plates are substantially orthogonal.

38. A wall panel system according to any one of claims 1 to 3, 6 to 13, and 19-22, wherein each of said second pair of concealing edges is convexly shaped.

39. A wall panel system according to any one of claims 1 to 3, 6 to 13, and 19-22, wherein said plates are made of transparent or semitransparent material, said system further including a light source positioned behind and illuminating said plates to provide improved visual appearance.

40. A wall panel system according to any one of claims 1 to 3, 6 to 13, and 19-22, wherein external surface of each said plate includes a section of a larger image, such that a combination of all plates creates an image that is substantially larger in size than the size of a single plate.

* * * * *